United States Patent [19]

Selz

[11] Patent Number: 5,036,979

[45] Date of Patent: Aug. 6, 1991

[54] COLLAPSIBLE CONTAINER

[76] Inventor: John C. Selz, 2549 Broadway, Toledo, Ohio 43609

[21] Appl. No.: 632,013

[22] Filed: Dec. 21, 1990

[51] Int. Cl.[5] ..... B65D 5/32

[52] U.S. Cl. ..... 206/512; 206/600; 206/386; 229/117.07

[58] Field of Search ..... 206/512, 600, 386; 229/117.07, 117.03, DIG. 11

[56] References Cited

U.S. PATENT DOCUMENTS

| | | | |
|---|---|---|---|
| 3,294,306 | 12/1966 | Areddy | 206/512 |
| 3,406,893 | 10/1968 | Swane | 206/512 |
| 4,373,637 | 2/1983 | Shippell . | |
| 4,660,724 | 4/1987 | Gaynes | 206/512 |
| 4,809,851 | 3/1989 | Oestreich, Jr. et al. | 206/600 |
| 4,949,898 | 8/1990 | Nederveld | 206/600 |

FOREIGN PATENT DOCUMENTS

| | | | |
|---|---|---|---|
| 670557 | 10/1965 | Belgium | 206/512 |
| 2119759 | 11/1983 | United Kingdom . | |

*Primary Examiner*—Stephen Marcus
*Assistant Examiner*—C. McDonald
*Attorney, Agent, or Firm*—Emch, Schaffer, Schaub & Porcello Co.

[57] ABSTRACT

A collapsible container foldable between an open position for receiving and containing goods and a closed position for storage has a pair of end walls pivotable about an upper scoreline to a position permitting a pair of side walls to be collapsed accordion fashion. The end walls have vertical posts and the end walls and side walls are fastened together by connector means having a post segment slideably retained therein. The post and post segments act as support columns. Other containers may be stacked thereon both in the open and collapsed condition.

16 Claims, 9 Drawing Sheets

COLLAPSIBLE CONTAINER

SUMMARY OF THE INVENTION

The present invention relates to a collapsible container which may be foldable between an open position for receiving and containing goods to a collapsed position for storage and which is stackable one on top of another both in the open and closed positions. The container may be formed of a combination of materials such as corrugated paperboard for the side walls, wood for a pallet-type frame for the base, wooden posts and plastic corner fasteners and supports.

IN THE DRAWINGS

DETAILED DESCRIPTION OF THE INVENTION

Figure 1:
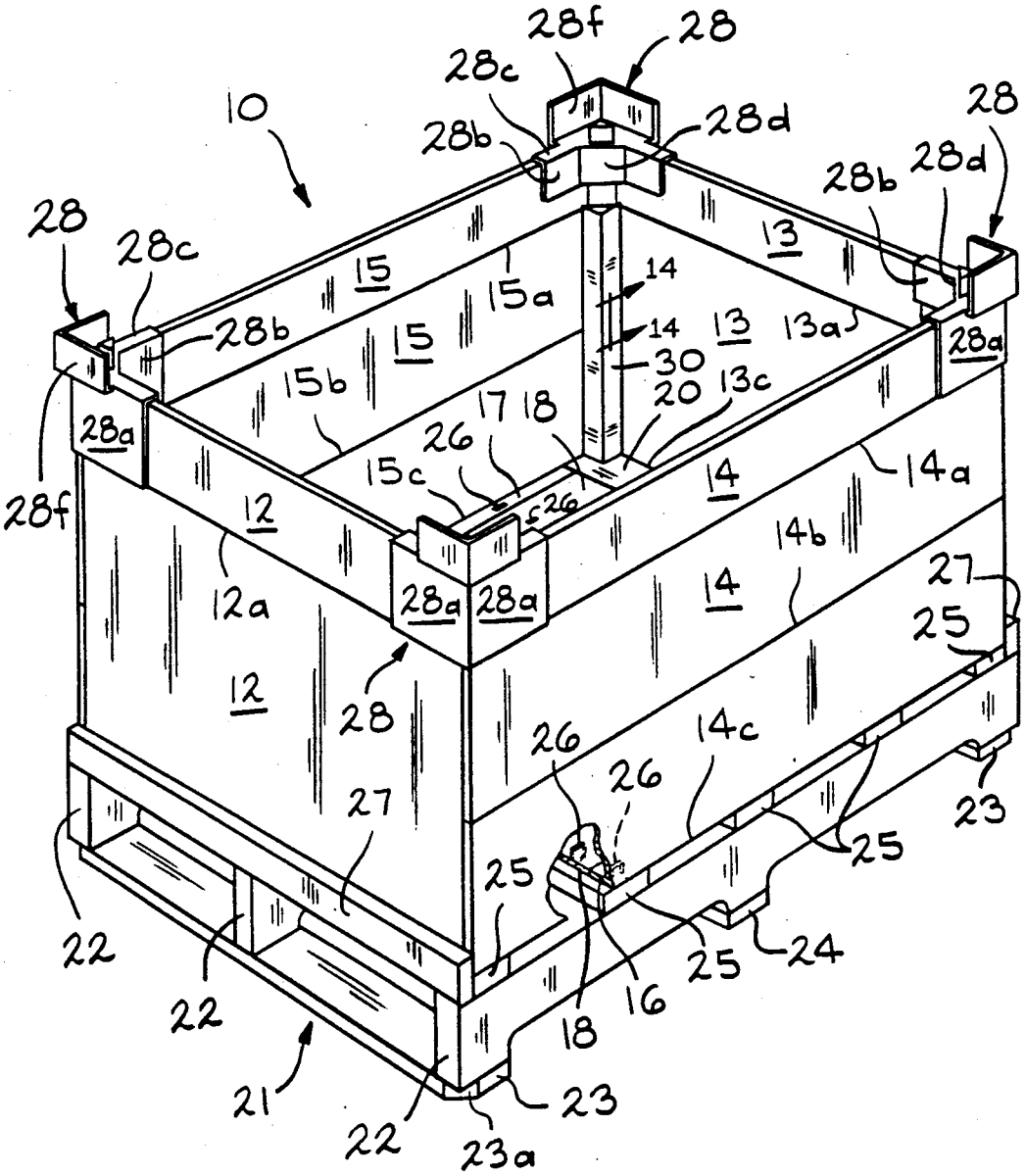
FIG. 1 is a perspective view of the collapsible container of the present invention in a fully open position.

Referring now to the drawings, there is shown in FIGS. 1-9 a collapsible container generally designated by the numeral 10 having a first end wall 12, a second end wall 13 and first and second side walls 14 and 15. Preferably, each of the end walls 12 and 13 and side walls 14 and 15 are formed of corrugated paperboard; however, they could be formed of other material such as a sheet of solid or foamed plastic. Each of the side walls 14 and 15 has a horizontally inwardly directed tab 16 and 17, respectively, nailed, stapled or otherwise secured to a lower support member such as a pallet 21 to be hereinafter described. Each of the side walls 14 and 15 has a first horizontal upper scoreline **14*a* and 15*a*, a second horizontal center scoreline 14*b* and 15*b* and a third horizontal lower scoreline 14*c* and 15*c*. Each of the scorelines 14*a*, 14*b*, 14*c*, 15*a*, 15*b* and 15*c* extend the full length of its respective side wall 14 and 15 and provide pivot lines about which the respective side walls 14 and 15 may be folded in collapsing the container. Each of the end walls 12 and 13 has a horizontal scoreline 12*a* and 13*a* on substantially the same plane as the upper scorelines 14*a* and 15*a*. The end walls 12 and 13 may be folded inwardly towards each other, pivoting about their respective scorelines 12*a* and 13*a***.

There is also provided a bottom panel 18 which is also preferably formed of corrugated paperboard. In the embodiment shown in FIGS. 1-9, the bottom panel 18 does not extend the full length of the respective side walls 14 and 15. Each of the end walls 12 and 13 has a horizontally inwardly directed tab 19 and 20, respectively. Each of the tabs 19 and 20 is folded about a lower scoreline **12*c* or 13*c* for its respective end wall 12 or 13 and meets with the bottom panel 18 in abutting relationship when the container 10 is in the fully open position. (See FIGS. 8 and 9**).

Figure 2:
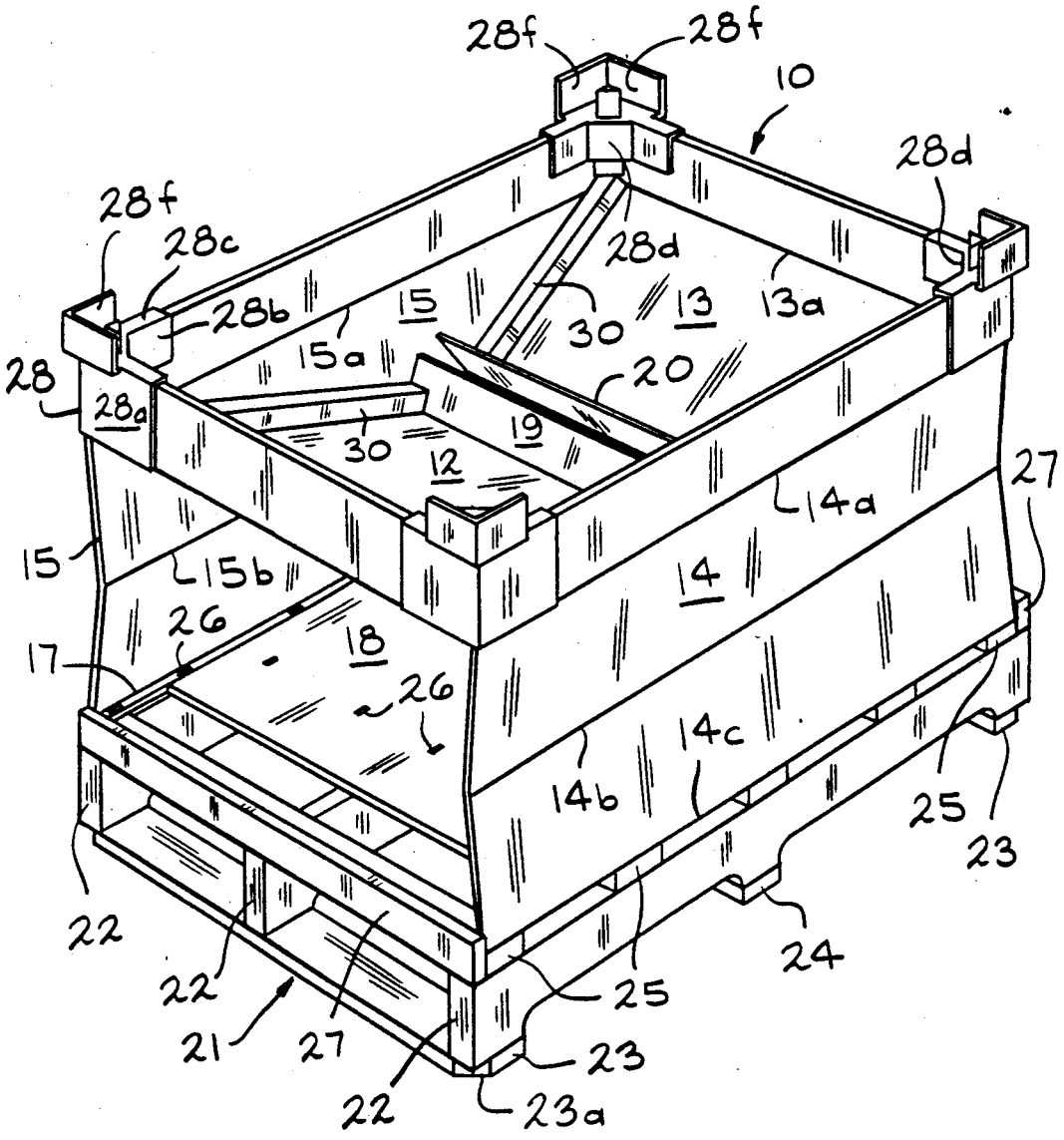
FIG. 2 is a perspective view of the collapsible container in the partially collapsed position.

The bottom panel 18 rests upon and is fastened to the pallet 21 which is preferably formed of wood. The pallet 21 includes a plurality of horizontal stringers 22 mounted upon a pair of end base boards 23 and a center base board 24 perpendicular to such stringers. The portions of the stringers 22 between each of the end base boards 23 and center base board 24 are shown as having reduced thickness in the vertical direction in order to provide spaces for receiving the tines of a forklift which may be used for moving the container. The portion of each of the end base boards 23 at each corner of the pallet 21 has a triangular notch removed therefrom thereby forming a diagonal face **23*a* and leaving the bottom surface of those portions of the stringers 22 adjacent each corner of the pallet 21 exposed. A plurality of cross boards 25 rests upon the stringers 22 and provide support for the bottom panel 18. As shown in FIGS. 1 and 2, the tabs 16 and 17 of the respective side walls 14 and 15 and the bottom panel 18 are fastened to the cross boards 25 of the pallet 21 by means of staples 26; however, as previously noted other fastening means may be provided. The pallet 21 also has two end pieces 27, one secured to each of the cross boards 25 at opposite ends thereof and/or to the stringers 22. Each of the end pieces 27 extends above the top of its respective cross board 25 and is engaged by the adjacent end wall 12 or 13 when the container 10 is in the fully open position shown in FIGS. 1 and 8. Thus, such portion of the end pieces 27 extending above the tops of the respective cross boards 25 serve as a stop to limit the amount of movement the end walls 12 and 13 can travel in pivoting about the scorelines 12***a* and 13*a*, respectively.

At each of the upper corners of the container 10 a molded plastic connector 28 is provided to connect the respective upper end of each of the end walls 12 and 13 to the adjacent portion of each of the side walls 14 and 15, respectively. The connectors 28 are molded in a U-shape and are provided with spaced apart outer legs 28*a* and inner legs 28*b* connected to each other by a horizontal top edge 28*c*. The connectors 28 telescope over upper edges of the end walls 12 and 13 and their respective adjacent upper edges of side walls 14 and 15. Thus, such upper edges fit in the space between the outer legs 28*a* and inner legs 28*b* of the connector 28 with the inner surface of the horizontal top edge 28*c* resting on the tops of such upper edges. The connectors 28 are adhesively or otherwise secured to each of the end walls 12 and 13 and side walls 14 and 15 at each of the corners.

Each of the connectors 28 is provided with a diagonal wall 28*d* which extends at a 45° angle between the adjacent inner legs 28*b* forming the corner. The diagonal wall 28*d* cooperates with the inner legs 28*b* on each side of the corner to define a vertically extending slot 28*e* having a triangular cross-sectional configuration.

Figure 8:
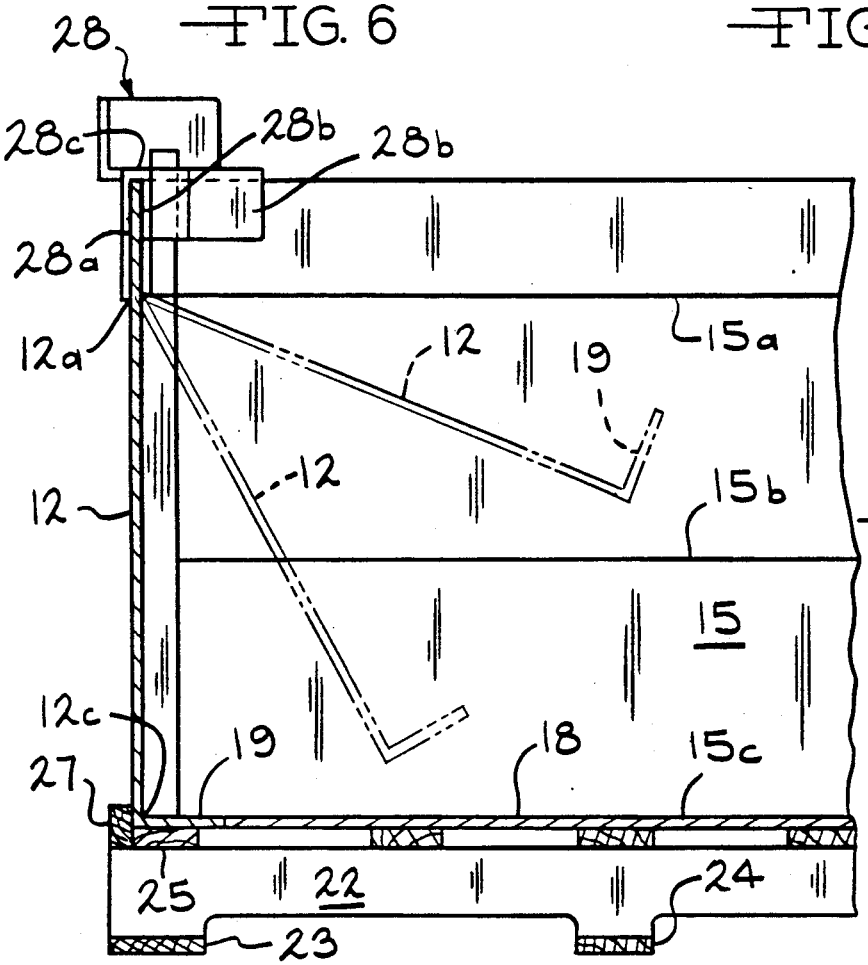
FIG. 8 is a side elevational view, in section, showing the collapsible container in the fully open position and showing in phantom lines the movement of one end wall as part of the procedure of collapsing the container.
Figure 9:
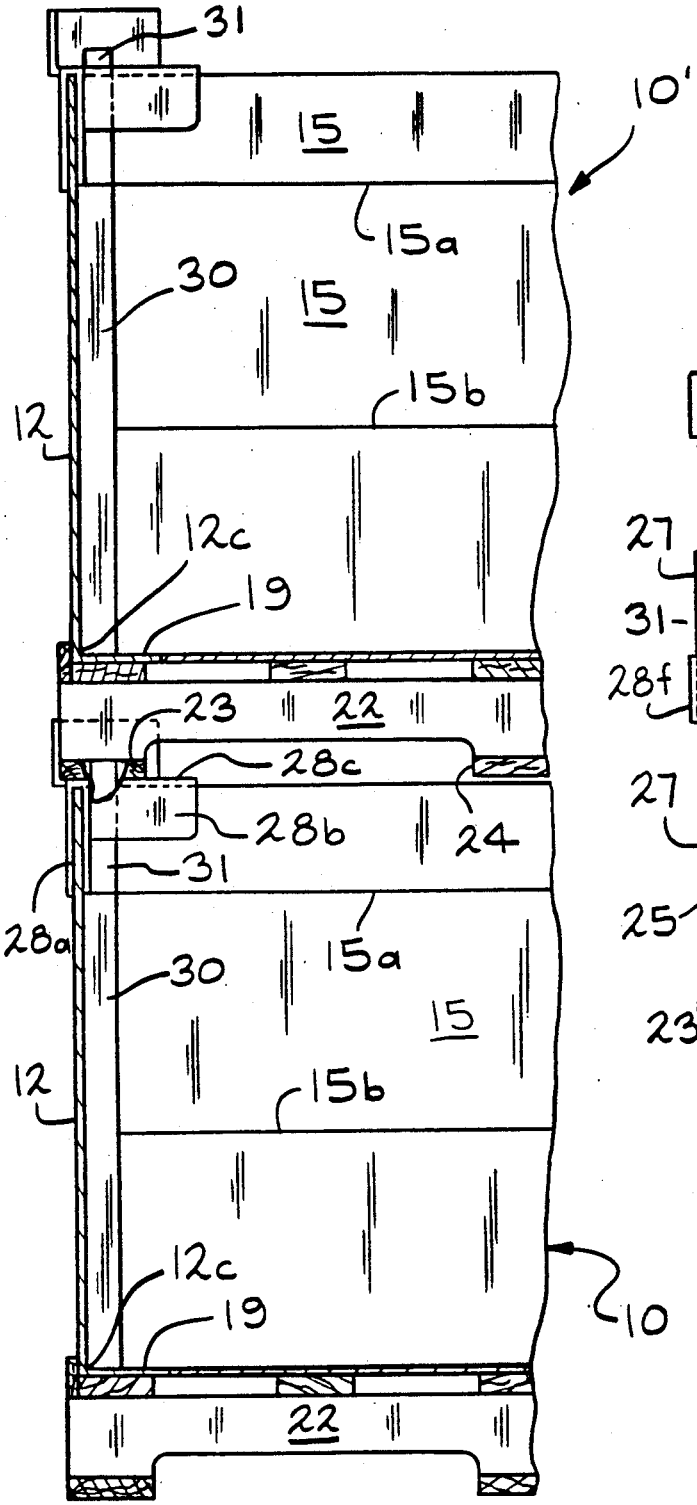
FIG. 9 is a side elevational view, in section, showing two containers in the fully open position and stacked one upon the other.

Each of the end walls 12 and 13 has fastened thereto at each of its edges adjacent one of the side walls 14 and 15, a post 30 which is vertical when the container is in the fully open position shown in FIGS. 1 and 8. Preferably the post 30 is formed of wood; however, it could be formed of plastic or other material which provides support in compression for a load transmitted against one end. Each post 30 extends from the bottom of its respective end wall 12 or 13 adjacent the respective tab 19 or 20 upwardly in a vertical direction to the scoreline 12*a* or 13*a*, respectively. Immediately above the post 30 is a post segment 31 which has a triangular cross-sectional configuration of a size permitting it to be slideably received in the slot 28*e* of the connector 28. As can be seen in FIGS. 1, 8 and 9, when the container 10 is in the fully opened position, the post segments 31 extend above the upper surface horizontal edge 28*c* of connector 28 by an amount equal to the thickness of the end base boards 23. The post segments 31 extending above the upper surface of horizontal edge 28*c*, are in position to be engaged by the lower corner surfaces of the stringers 22 of an upper container 10' positioned thereon and serve to transmit loads to the posts 30 to provide the structural support for such upper container 10' without collapsing the lower container 10. Thus, the the upper ends of the post segments 31 engaging the lower corner surfaces of the stringers 25 will be adjacent the diagonal faces 23*a* of the end base boards 23 of an upper container 10' positioned thereon and will serve to properly align such upper container 10' on a lower container 10.

If desired, each of the connectors 28 may be provided with an L-shaped extension 28*f* extending upwardly from the horizontal edge 28*c*. In the vertical direction, the L-shaped extension 28*f* is outwardly of the outer legs 28*a*. As may be seen in FIGS. 9 and 10, the L-shaped extensions 28*f* serve to assist in providing proper alignment for a container stacked thereon.

Figure 3:
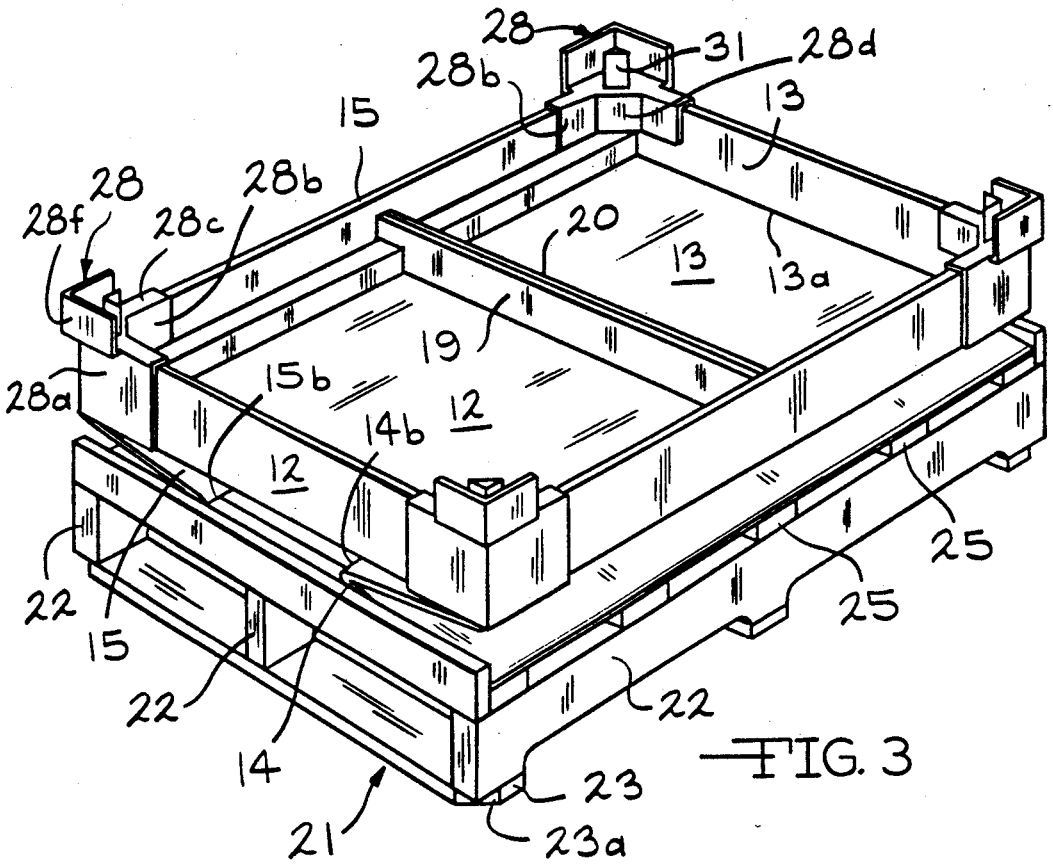
FIG. 3 is a perspective view of the collapsible container in a fully collapsed position.
Figure 4:
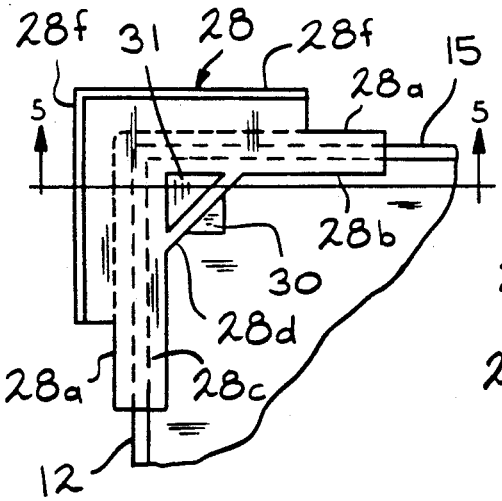
FIG. 4 is a fragmentary top plan view showing one corner of the collapsible container of the present invention.
Figure 5:
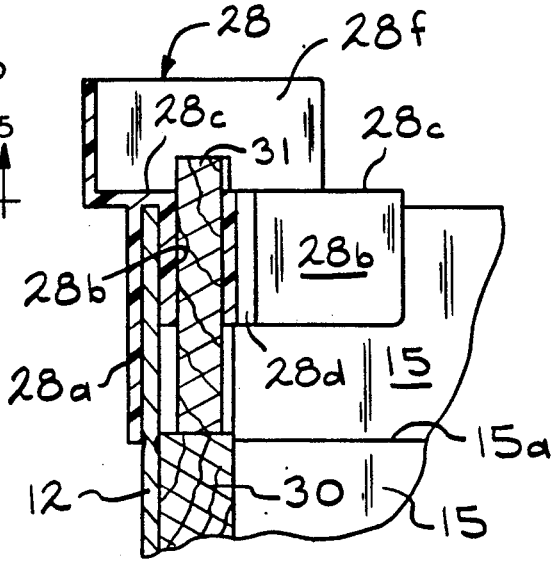
FIG. 5 is a sectional view taken through line 5—5 of FIG. 4 showing the positioning of the respective parts when the collapsible container is in the fully open position of FIG. 1.
Figure 6:
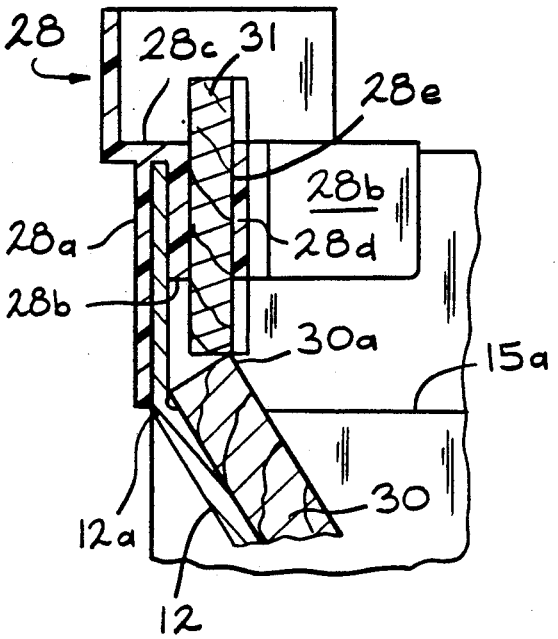
FIG. 6 is a view similar to FIG. 5 showing the collapsible container in the partially collapsed position of FIG. 2.
Figure 7:
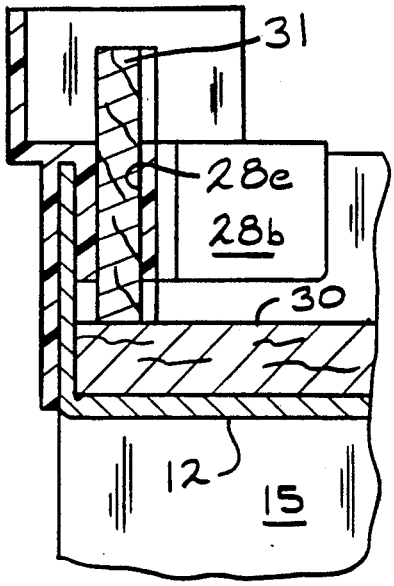
FIG. 7 is a view similar to FIG. 5 showing the collapsible container in the fully collapsed position of FIG. 3.

In order to move the container 10 from the open position to the collapsed position, the end tab 19 of end wall 12 and end tab 20 of end wall 13 are moved upwardly out of abutting relationship with the bottom panel 18 and the end walls 12 and 13 are then folded inwardly as shown in FIGS. 2 and 6 until reaching a fully horizontal position substantially parallel to the scorelines 14*a* and 15*a* of the side walls 14 and 15 as shown in FIGS. 3 and 7. If the height of the panels 12 and 13 from their respective upper scorelines 12*a* and 13*a* to their respective lower scorelines 12*c* and 13*c* are each equal to one-half of the length of the sidewall 14 or 15, the respective end tabs 19 and 20 of the end walls 12 and 13 will abut one another when the end walls 12 and 13 are in the horizontal position. The side walls 14 and 15 are then pivoted about their respective scorelines 14*a*, 14*b*, and 14*c* and 15*a*, 15*b* and 15*c* so that each such side wall folds over about itself as shown in FIG. 3. As can be seen particularly in FIGS. 6, 7 and 8, movement of the end wall 12 and of the end wall 13 (not shown in these figures) from a vertical, opened position where its lower edge adjacent the end tab 19 is in engagement with the extension of the end board 27 and its aligned cross board 25 to the fully horizontal position (FIG. 7) preparatory to collapsing, causes the upper inner corners 30*a* of the posts 30 to push the post segments 31 upwardly in their respective slots 28*e*.

Figure 10:
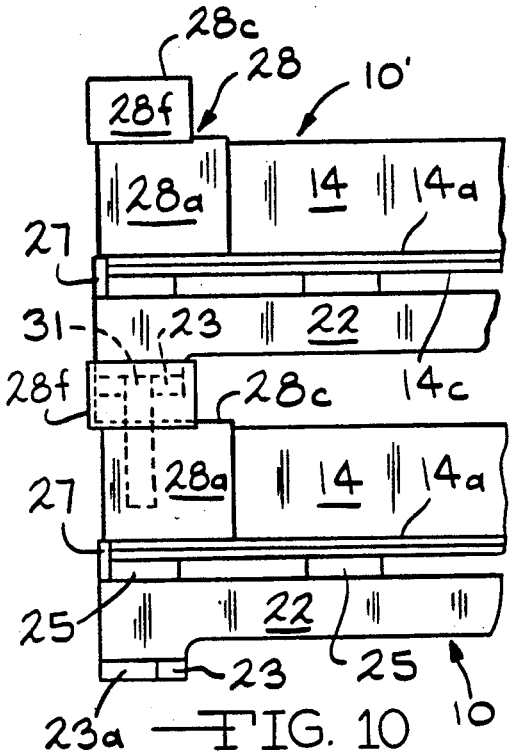
FIG. 10 is a fragmentary elevational view, in section, showing two containers in the collapsed position stacked one upon the other.

As can be seen in FIG. 10, a collapsed container 10' resting upon another collapsed container 10, will have its base boards 23 spaced above the connectors 28 horizontal edge 28*c* more than a container resting upon an open container 10 because of the fact that the post segments 31 were pushed up when the end walls 12 and 13 were moved from the vertical to horizontal position.

Figure 11:
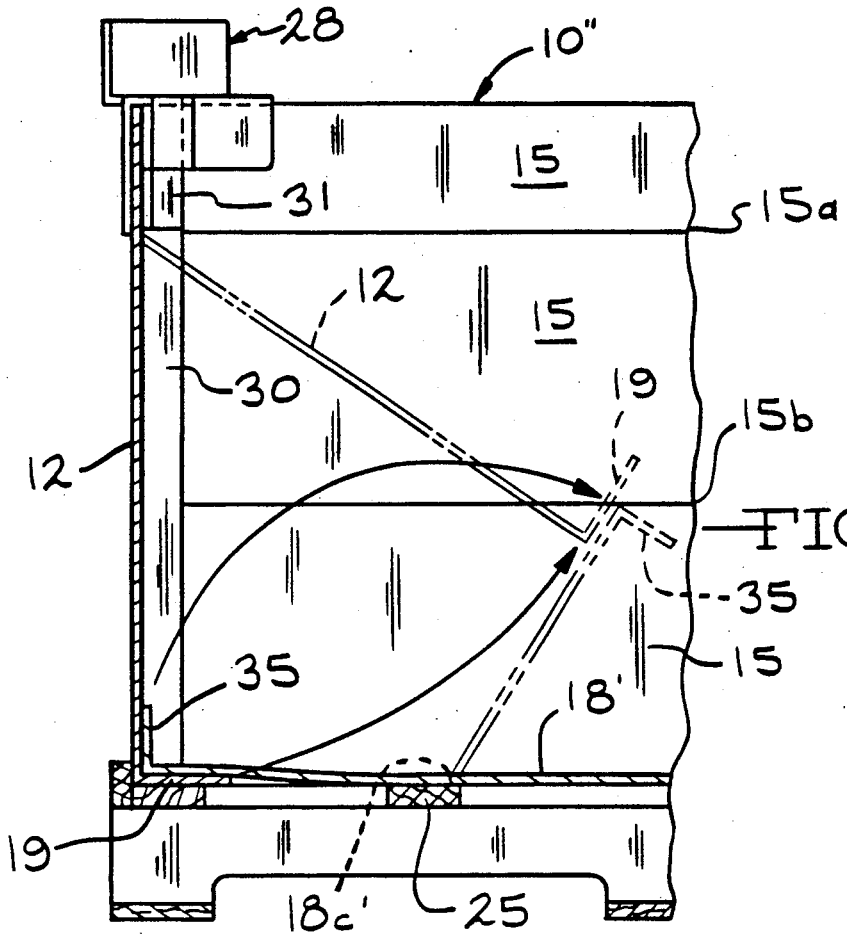
FIG. 11 is a side elevational view, in section, of a modified embodiment showing the collapsible container in the fully opened position and showing in phantom lines the movement of the bottom wall and one end wall as part of the procedure of collapsing the container.

Referring now to FIG. 11, there is shown a modified container 10'' in which bottom panel 18' extends the full distance between the end walls 12 and 13 with the result that such bottom panel 18' overlaps the tabs 19 and 20 of the respective end walls 12 and 13. In this embodiment the bottom 18' may also be provided at each of its ends with an upstanding tab 35 which engages the lower portion of the adjacent end walls 12 and 13, respectively, when the container 10'' is fully opened to assist in retaining such end walls 12 and 13 in the open position.

In order to collapse the container 10'' of the embodiment of FIG. 11, it is necessary to first lift the end portion of such bottom panel 18' and pivot it out of the way of the end wall 12 as it moves from its vertical to its horizontal position preparatory to collapsing. The bottom panel 18' is thus provided with a scoreline 18*c'* about which the outer ends of the bottom panel 18' adjacent the respective end walls 12 and 13 may pivot. The bottom will desirably be fastened to a cross board 25 in the vicinity of the scoreline 18*c'*.

Figure 12:
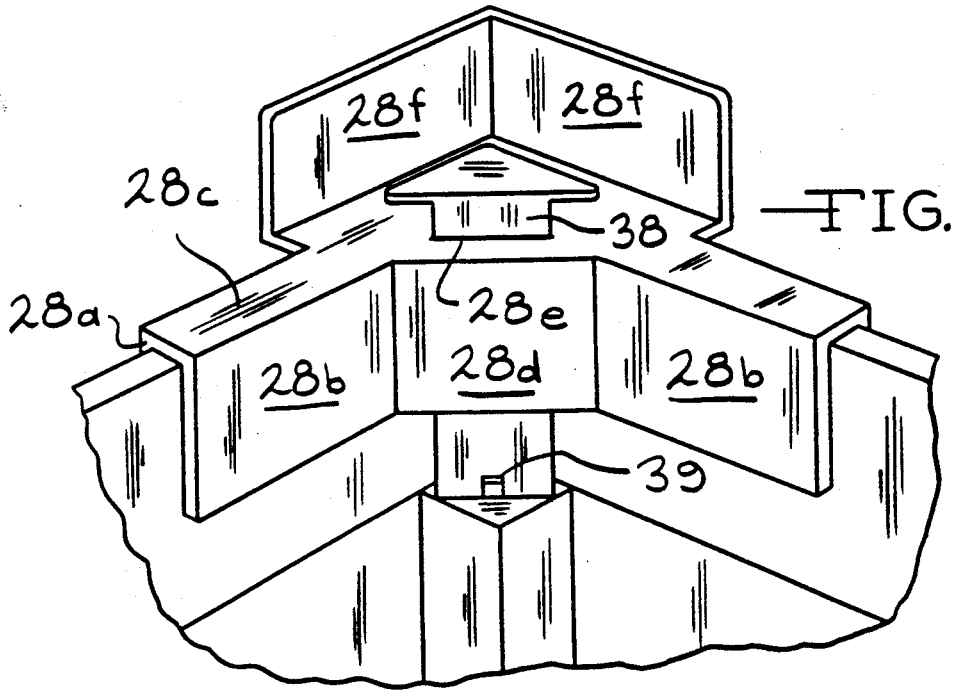
FIG. 12 is a fragmentary perspective view of one corner showing a modified embodiment.
Figure 13:
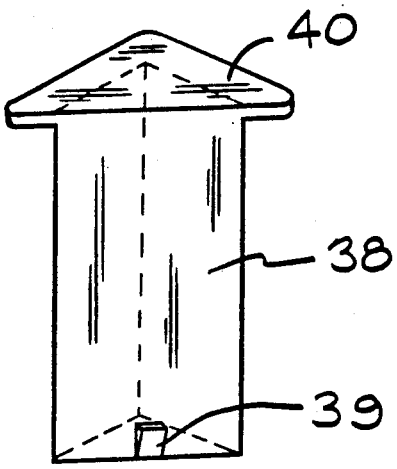
FIG. 13 is a perspective view showing a modified post segment.

Referring now to FIGS. 12 and 13, there is provided a modified post segment 38. In this embodiment the post segment 38 is formed of molded plastic and is provided with a tab member 39 at its lower end which serves as a retainer to prevent the post segment 38 from sliding out of the slot 28*e* if the container 10 is turned over. Thus, the tab 39 member is normally in a outwardly extending position from the wall but may be yieldingly urged inwardly for insertion in the slot 28*e* and will snap outwardly as it passes below the bottom of the member 28*d*. The modified post segment 38 is also provided with a flange 40 for resting upon the horizontal edge 28c of the connector 28.

Figure 14:
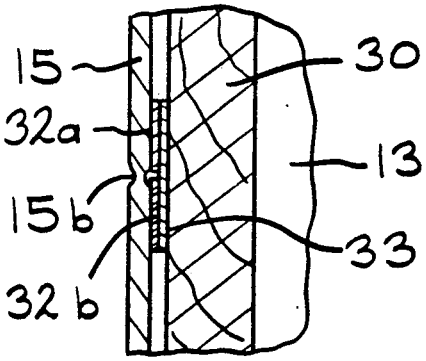
FIG. 14 is a fragmentary sectional view taken through line 14—14 of FIG. 1 showing an optional locking feature which may be incorporated in the collapsible container of the present invention.
Figure 15:
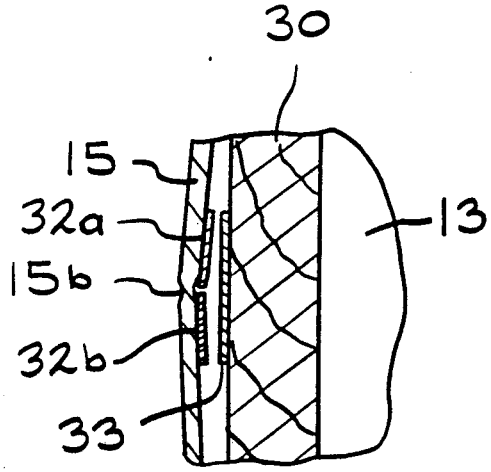
FIG. 15 is a view similar to FIG. 14 but showing the locking feature of FIG. 14 in an opened position preparatory to collapsing the container.
Figure 16:
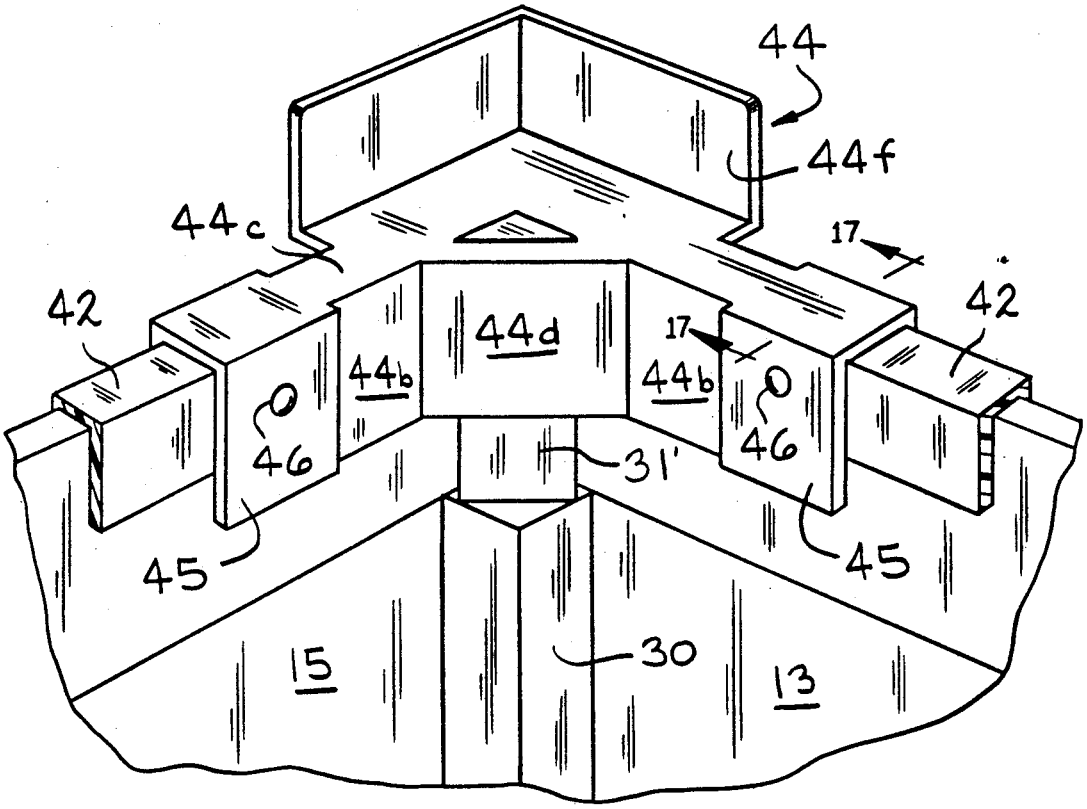
FIG. 16 is a perspective view of a top corner of another embodiment.
Figure 17:
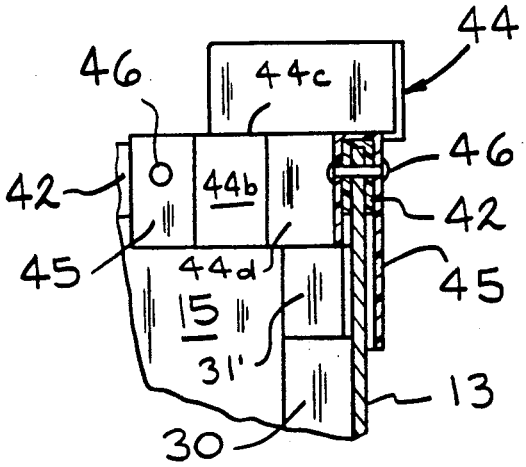
FIG. 17 is a sectional view taken through line 17—17 of FIG. 16.
Figure 18:
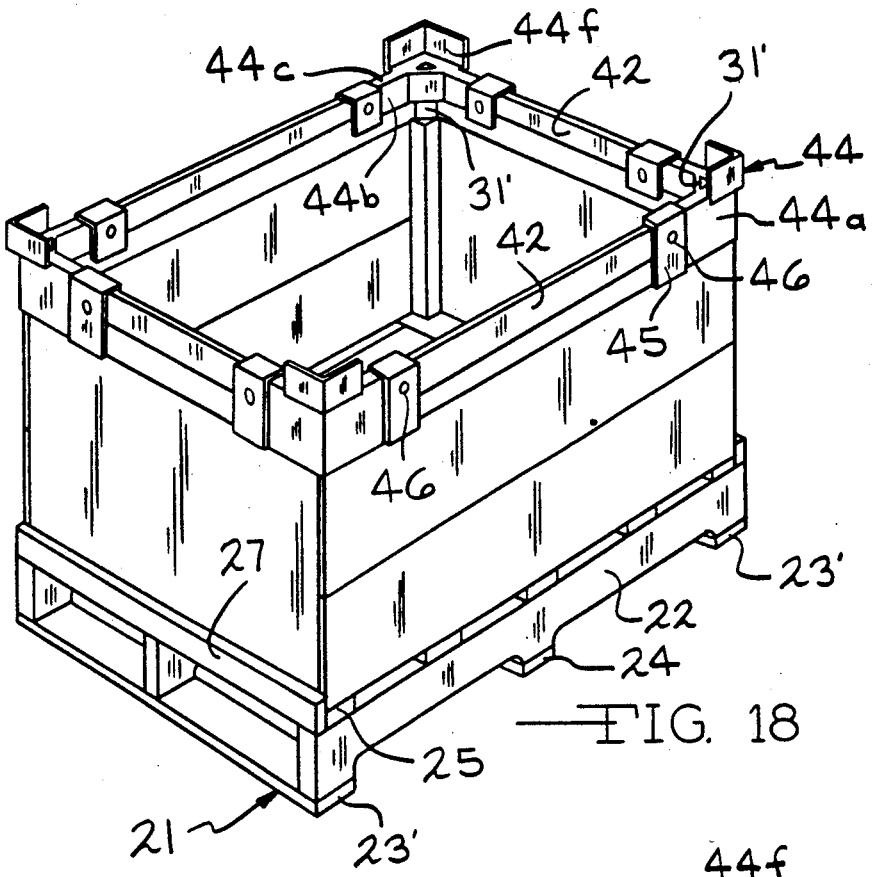
FIG. 18 is a view similar to FIG. 1 showing another embodiment.
Figure 19:
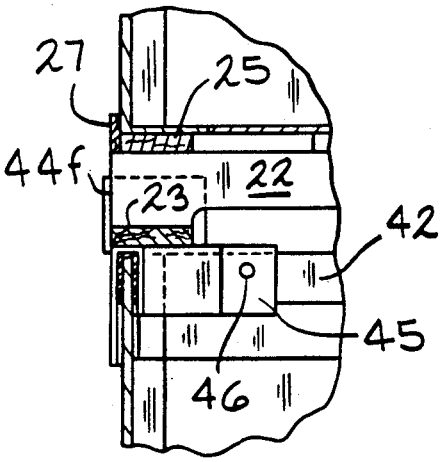
FIG. 19 is a fragmentary view of the embodiment of FIG. 18 showing two containers in the fully open position stacked one upon the other.
Figure 20:
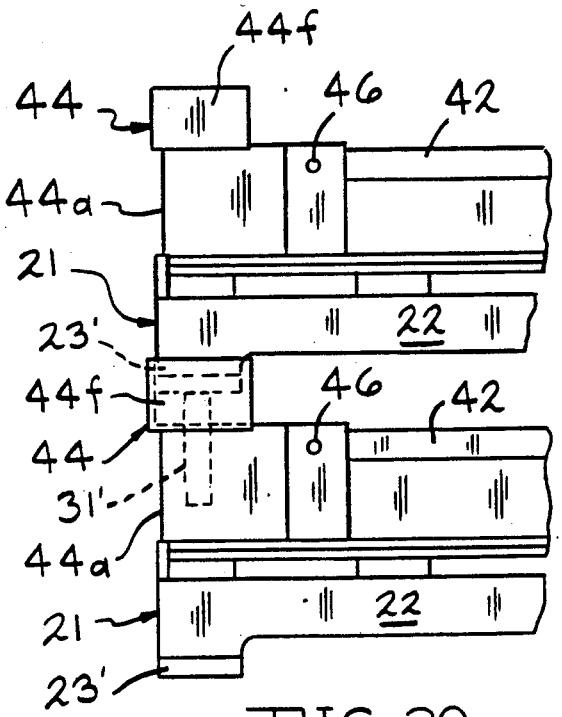
FIG. 20 is a fragmentary view of the embodiment of FIG. 18 showing two containers in the collapsed position stacked one upon the other.

Referring now to FIGS. 14 and 15, there is shown an embodiment in which each of the respective side walls 14 and 15 may be releaseably connected to one of the posts 30. Under this embodiment, sets of Velcro fasteners having hook members 32a and 32b are adhesively fastened to each the side walls 14 and 15, one set of hook members at each end of each of the side walls 14 and 15. Preferably, there are two hook members 32a and 32b in each set of Velcro fasteners, one hook member 32a above and the other hook member 32b below central scoreline 14b or 15b at each end of each of the sides 14 and 15. Each set of Velcro fasteners also includes a retaining member 33 adhesively secured to the post 30 in a position to be engaged by the hook members 32a and 32b. When the container 10 is in the fully open position the hook members 32a and 32b are fastened to the retaining member 33 and are fastened together to provide additional support means between the respective end walls 12 or 13 and adjacent portion of the side walls 14 and 15. In FIGS. 1 and 14, the Velcro fastener is shown fastening the side wall 15 to the posts 30 connected to end walls 12 and 13. When it is desired to collapse the container 10, the hook members 32a and 32b are separated from the retaining member 33 of the Velcro fastener so that the end panels 12 and 13 may be rotated about their respective scorelines 12a and 13a without interference.

Referring now to FIGS. 16 through 20, there is shown a modified embodiment in which there is provided a U-shaped reinforcing member 42 secured to the upper edges of the end walls 12 and 13 and side walls 14 and 15 and extending the full distance across such upper edges from a connector at one corner to the connectors at the opposite corners. Under this embodiment there is provided a modified connector 44 having enlarged end segments 45 sized to receive the reinforcing members 42. A rivet or support pin 46 extends through each of the enlarged end segments 45 of the connector 44 and the reinforcing member 42 and also extends through the upper end of the respective end walls 12 and 13 and side walls 14 and 15 for its respective corner.

Another feature of this embodiment is provision of the post segment 31' which terminates flush with the upper surface of the horizontal top edge 44c of the connector 44 when the container 10 is in the fully opened position. In this embodiment, the end base boards 23' extend fully to the corners and do not have a notch forming a diagonal face. Thus, when an upper container 10' is stacked on the lower one of such containers, the bottom of the end base boards 23 will rest upon and engage the upper end of the post segment 31'; however, such post segment 31' will not function to align the upper container thereon. Under this embodiment, alignment of the upper container thereon will be provided by the L-shaped extensions 44f.

The container of the present-invention provides the structural strength both for containing articles and for supporting other containers which may be stacked thereon. The container may be readily moved from an open to a collapsed position, may be readily lifted by a forklift or other material handling equipment and may be stacked irrespective of whether it is open or collapsed.

Many modifications will be readily apparent to those skilled in the art. Accordingly, the scope of the invention should be determined only by the scope of the appended claims.

I claim:

1. A collapsible container foldable between an open position for containing goods and a collapsed position comprising:

(a) support means;

(b) a bottom wall engaging said support means;

(c) a pair of spaced apart side walls supported by and extending upwardly from said support means to an upper edge;

(d) a pair of end walls, each having a pair of side edges and an upper edge extending between said side walls, said end walls cooperating with said side walls to define a rectangular cross-sectional configuration;

(e) connector means for joining the upper edge and an adjacent portion of each of said side walls with the upper edge and an adjacent portion of each of said end walls;

(f) each of said end walls and said side walls having a first scoreline parallel to and spaced from its upper edge;

(g) each of said side walls having a second scoreline parallel to said first scoreline substantially midway between said first scoreline and said support means;

(h) a pair of support posts fastened to each of said end walls, one adjacent each of said side edges, said support posts engaging said support means when said container is in the open position;

(i) said end walls being foldable about said first scoreline from the position of clause (h) to a position substantially parallel to said first scoreline of said side walls;

(j) said side walls being foldable about their said first and second scorelines when said end walls are in the position of clause (i) to collapse said container.

2. A collapsible container according to claim 1, further including means for supporting a container stacked thereon, said means for supporting comprising a post segment slideably engageable with each of said connector means, each post segment being aligned with and having a lower end resting upon a support post when said end walls are in the position of clause (h) and an upper end for engagement by a container stacked thereon.

3. A collapsible container according to claim 2, wherein each of said support posts urges its aligned post segment upwardly within said connector means when said end walls are folded from the position of clause (h) to the position of clause (i).

4. A collapsible container according to claim 3, wherein said post segment upper end extends above said connector means when said end walls are in the position of clause (h) and wherein said support means are provided with alignment means cooperable with said post segments upper ends for aligning an upper container stacked upon a lower container.

5. A collapsible container according to claim 3, wherein each of said connector means includes a support ledge and wherein said post segment upper end is substantially flush with said support ledge when said end walls are in the position of clause (h).

6. A collapsible container according to claim 5 further including alignment means on said connector means for aligning a container stacked upon said connector means.

7. A collapsible container according to claim 6, wherein said alignment means comprises flange means extending upwardly from each of said connector means to a position above said support means.

8. A collapsible container according to claim 2 further including tab means for retaining said post segment to said connector means.

9. A collapsible container according to claim 1 further including means for releasibly engaging said side walls, in the vicinity of said second scoreline, to the support post adjacent thereto.

10. A collapsible container according to claim 9, wherein each of the opposing ends of said reinforcing means is fastened to both said connector means and the end wall or side wall being reinforced thereby.

11. A collapsible container according to claim 1 further including reinforcing means for the upper edges of said end walls and the upper edges of said side walls, each of said reinforcing means extending between opposing connector means.

12. A collapsible container foldable between an open position for containing goods and a collapsed position comprising:

(a) support means;

(b) a bottom wall engaging said support means;

(c) a pair of spaced apart side walls supported by and extending upwardly from said support means to an upper edge;

(d) a pair of end walls, each having a pair of side edges and an upper edge extending between said side walls, said end walls cooperating with said side walls to define a rectangular cross-sectional configuration;

(e) connector means for joining the upper edge and an adjacent portion of each of said side walls with the upper edge and an adjacent portion of each of said end walls;

(f) each of said side walls having a central scoreline parallel to said bottom wall;

(g) a pair of support posts fastened to each of said end walls, one adjacent each of said side edges, said support posts being supported on said support means when said container is in the open position;

(h) said end walls being rotatable from a position where the support posts are supported on said support means to a position substantially parallel to the upper edges of said side walls;

(i) said side walls being foldable about their respective scorelines when said end walls are parallel to the upper edges of said side walls to collapse said container.

13. A collapsible container according to claim 12 further including means for supporting a container stacked thereon, said means for supporting comprising a post segment slidably engageable with each of said connector means, each post segment being aligned with and having a lower end resting upon a support post when said end walls are in the position of clause (g) and an upper end for engagement by a container stacked thereon.

14. A collapsible container according to claim 13, wherein each of said support posts urges its aligned post segment upwardly within said connector means when said end walls are rotated from the position of clause (g) to the position of clause (h).

15. A collapsible container according to claim 14, wherein said post segment upper end extends above said connector means when said end walls are in the position of clause (g) and wherein said support means are provided with alignment means cooperable with said post segments upper ends for aligning a container stacked thereon.

16. A collapsible container according to claim 14, wherein each of said connector means includes a support ledge and wherein said post segment upper end is substantially flush with said support ledge when said end walls are in the position of clause (g).

* * * * *